US005582038A

United States Patent [19]

Braun et al.

[11] Patent Number: 5,582,038

[45] Date of Patent: Dec. 10, 1996

[54] KNITTING NEEDLE HAVING ANCHORING MEANS FOR A FILLER HELD IN THE NEEDLE SHANK

[75] Inventors: Erich Braun, Nusplingen; Albert Teufel, Veringenstadt, both of Germany

[73] Assignee: Theodor Groz & Söhne & Ernst Beckert Nadelfabrik Commandit-Gesellschaft, Albstadt, Germany

[21] Appl. No.: 566,124

[22] Filed: Dec. 1, 1995

[30] Foreign Application Priority Data

Dec. 2, 1994 [DE] Germany ..... 44 42 943.6

[51] Int. Cl.[6] ..... D04B 35/02

[52] U.S. Cl. ..... 66/123; 66/121

[58] Field of Search ..... 66/121, 123

[56] References Cited

U.S. PATENT DOCUMENTS

| | | | |
|---|---|---|---|
| 4,553,411 | 11/1985 | Schuler et al. | 66/123 |
| 4,562,705 | 1/1986 | Berentzen | 66/121 |
| 4,783,976 | 11/1988 | Sos | 66/121 |
| 4,817,399 | 4/1989 | Sos et al. | 66/123 |
| 5,029,456 | 7/1991 | Sos et al. | 66/123 |
| 5,094,091 | 3/1992 | Treuz et al. | 66/123 |

FOREIGN PATENT DOCUMENTS

| | | | |
|---|---|---|---|
| 0282647 | 9/1988 | European Pat. Off. . | |
| 3314809 | 9/1985 | Germany . | |
| 2003942 | 3/1979 | United Kingdom | 66/123 |

*Primary Examiner*—John J. Calvert
*Attorney, Agent, or Firm*—Spencer & Frank

[57] ABSTRACT

A stamped knitting tool includes a shank and a window which is provided in the shank and which is bounded by a surrounding window-framing edge of the shank. Along at least a length portion of the window-framing edge a chamfer is provided which borders the window. A heterogenous material fills the window and is fixedly connected with the shank. The chamfer projects into the heterogenous material.

10 Claims, 3 Drawing Sheets

KNITTING NEEDLE HAVING ANCHORING MEANS FOR A FILLER HELD IN THE NEEDLE SHANK

CROSS REFERENCE TO RELATED APPLICATION

This application claims the priority of German Application No. P 44 42 943.6 filed Dec. 2, 1994, which is incorporated herein by reference.

BACKGROUND OF THE INVENTION

This invention relates to a stamped knitting tool for textile machines, particularly knitting machines and is of the type which has a shank carrying at least one butt and being provided with at least one free space (also referred to hereafter as "window") which is filled with a heterogenous material, particularly a plastic material fixedly secured to the shank.

By "knitting tools" there are meant latch needles, spring-beard needles, compound needles, latchless needles (for example, hooks for working on plush material), as well as sinkers and the like.

German Patent No. 3,314,809 discloses a stamped knitting tool of the above-outlined type wherein at least one window is provided in the tool shank; the window is constituted by an elongated opening whose longitudinal axis is parallel to or coaxial with the longitudinal shank axis. The elongated aperture is bordered by two vertical guiding parts extending from the upper shank edge to the lower shank edge and two narrow webs which interconnect the guiding parts and which are oriented parallel to one another. The window is filled with a vibration damping material which is fixedly connected with the needle shank. The vibration damping material is, as a rule, an elastic plastic having substantial damping properties; yet, the use for other materials is not excluded. The above-noted German patent describes several embodiments having one or more windows enclosed by the webs and guiding parts.

The oscillation damping material disposed in the window or windows, as it has been found in practice, advantageously affects the vibration behavior of the knitting tool. It is possible to provide the knitting tool with a highly elastic construction having web heights of maximum 1.1 mm and to use the knitting tools over long operational periods with high working speed without experiencing, to an appreciable extent, web fractures caused by metal fatigue or hook breakages.

Since the oscillation damping material that fills the window in the needle shank may be effective only if it is fixedly connected with the material of the shank along the edge of the window, particularly in case of very thin needles which in the zone of the window are exposed to bending by laterally attacking forces, additional measures have been taken to ensure a form-fitting anchoring of the plastic filler in the window. Thus, European Published Application 0 282 647 discloses that the web parts or guiding parts which bound the window are given a particular shape (profile). Such a shape may have regions of reduced wall thicknesses which are either arranged in a locally limited manner or extend as strips over the entire outline of the window or a part thereof. Such regions of reduced wall thickness extend into the plastic material that fills the window and contribute to its form-fitting anchoring to the shank.

It has been found in practice that the making of knitting tools, particularly needles having windows provided therein which along the window-framing edges of the shank have profiled zones of reduced shank thickness are relatively difficult to make and are relatively expensive. For forming such an anchoring means for the plastic material, particularly made stamping tools are required and, especially in case of windows bounded by webs of small height, precautions have to be taken to prevent drawing of the thin webs during manufacture. The zones of reduced shank thickness adjoining over the rectangular shoulder zones at the shank may lead, at high dynamic stresses of the knitting tool, to locally limited stress peaks which adversely affect the service life of the knitting tool.

SUMMARY OF THE INVENTION

It is an object of the invention to provide an improved knitting tool of the above-outlined type which ensures with simple means a superior anchoring of the heterogenous material that fills the window of the tool shank.

This object and others to become apparent as the specification progresses, are accomplished by the invention, according to which, briefly stated, the stamped knitting tool includes a shank and a window which is provided in the shank and which is bounded by a surrounding window-framing edge of the shank. Along at least a length portion of the window-framing edge a chamfer is provided which borders the window. A heterogenous material fills the window and is fixedly connected with the shank. The chamfer projects into the heterogenous material.

Thus, according to the invention, the shank is, along its edge bounding (framing) the plastic-containing window, chamfered at least in sections, and the chamfered edge regions extend into the heterogenous material filling the window. The chamfer at the edge of the window results in a secure external anchoring of the material, particularly plastic. The chamfered zones may be embossed into the shank by means of a simple and inexpensive stamping tool having a long service life. Since during the embossing process the displaced material flows in the direction of the window, the shank zones which are not embossed are not affected by the embossing process. This is particularly of significance in case the window is, in the direction of the upper and/or lower external, longitudinal shank edge, bounded by webs of small height, whose cross section thus remains unchanged.

Particularly advantageously, the chamfered zones are, in the direction of the window, bounded by a hollow wedge, or, stated differently, the chamfer crest is formed by a depression. The depression (hollow wedge) acts as a second, inner form-locking anchoring for the material and thus enhances its positioning. The depression is obtained automatically during the embossing process, because the shank material is displaced inwardly towards the window. Other embodiments are also feasible in which the depression is made in a different manner, for example, by material removal (grooving).

Dependent upon the type and configuration of the knitting tool, the chamfered zones along the periphery of the window may be locally limited or may extend continuously about the closed outline of the window (that is, along the window-framing edge of the shank).

Thus, in knitting tools whose shank is, in the above-noted manner, provided with at least one window shaped as an elongated hole which is bounded in the direction of the upper and lower edge of the shank by a web of small height, the arrangement may be such that chamfered zones are provided at the webs. Those portions of the window-framing shank edge which connect the two webs with one another at the opposite ends of the window and which are, as a rule, semicircularly bent parts, may be in certain embodiments at least partially without chamfers if such a solution is judged to be advantageous as concerns a favorable stress distribution in the shank material. The chamfered zones may extend entirely over the curved window-framing edge portions.

Particularly in dynamically highly stressed knitting tools such as needles for high performance knitting machines, it has been found to be of particular advantage to shape at least one of the curvilinear window-framing edge zones substantially as a partial ellipse and the chamfers then, as a rule, extend along the entire curved zone. In this manner, the transition between the straight and the curvilinear parts of the window-framing shank edge has a more favorable stress distribution, leading to a particularly high dynamic resistance of the knitting tool.

DESCRIPTION OF THE PREFERRED EMBODIMENTS

Figure 1:
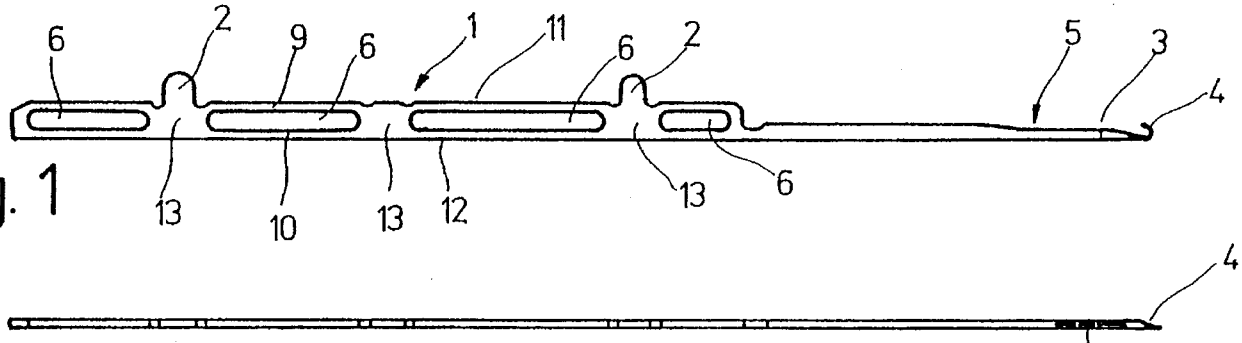
FIG. 1 is a schematic side elevational view of a latch needle incorporating the invention.
Figure 2:
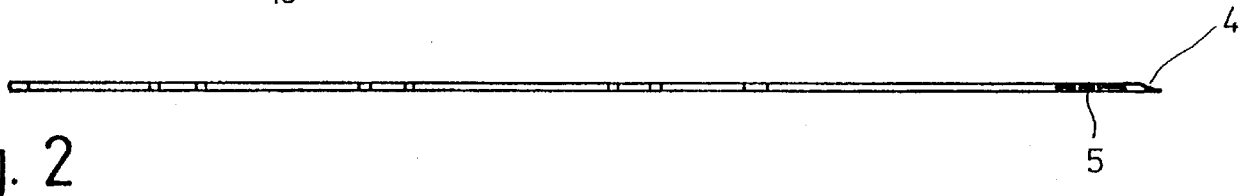
FIG. 2 is a top plan view of the construction shown in FIG. 1.

The latch needle illustrated in FIGS. 1 and 2 has a needle shank 1 which is conventionally stamped out of a steel ribbon and has, along its upper external, longitudinal edge, two spaced butts 2 followed, at one end of the shank, by a needle head 3 including a needle hook 4 cooperating with a needle latch 5.

Figure 6:
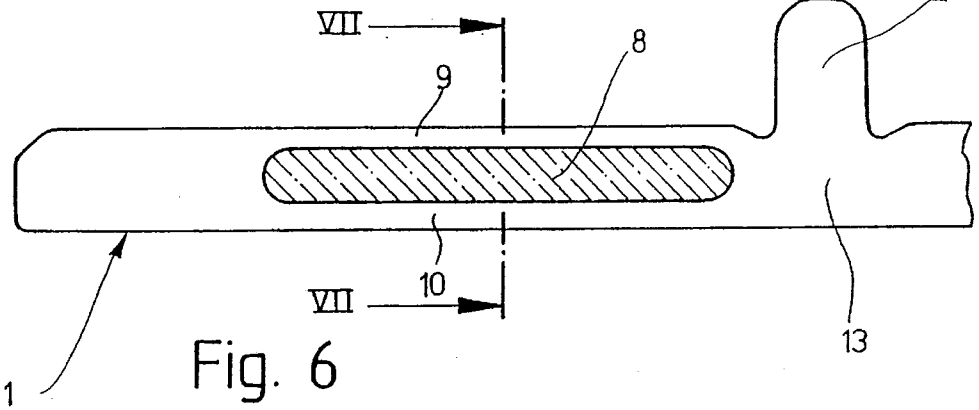
FIG. 6 is a view similar to FIG. 3, showing a heterogenous material occupying the window.

In the illustrated embodiment, four axially spaced throughgoing longitudinal apertures 6 are stamped into the needle shank. Each longitudinal aperture 6 constitutes a window which is filled with a heterogenous material 8 in a manner shown in FIGS. 6 and 7. The heterogenous material is fixedly connected with the shank 1 along the periphery of each aperture 6. The material is, as a rule, a plastic, for example, polyamide-12, polyurethane, polyethylene or polytetrafluoroethylene or the like. It is feasible to utilize inorganic material, for example, a metal.

Figure 7:
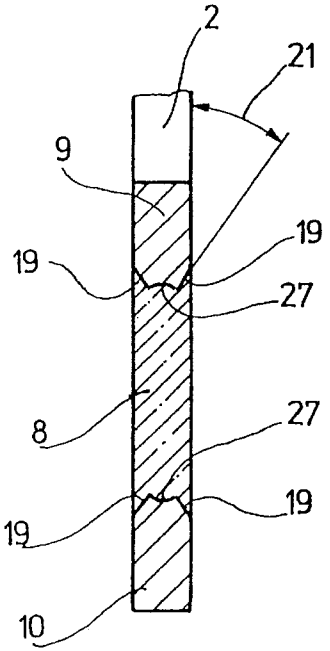
FIG. 7 is an enlarged sectional view taken along line VII—VII of FIG. 6.

Each elongated aperture 6 is on its long sides bounded by two parallel webs 9, 10 and along its short sides by two guiding parts 13 extending from the upper shank edge 11 to the lower shank edge 12. Each butt 2 is situated above one of the guiding parts 13. The two webs 9 and 10 are shank portions defined by and containing a straight window-framing edge portion of the shank as well as a portion of the respective upper shank edge 11 or the lower shank edge 12. The webs 9 and 10 have a small height of preferably approximately 1.1 mm or less. Their length is expediently in excess of 8 mm. In the embodiment shown in FIGS. 1–7, the outline of each elongated aperture 6 is thus bounded essentially by straight lines 14 and 15 between the webs 9, 10 which are connected to one another by two semicircularly curving lines 16, 17. In FIG. 7 the radius of the curved line 17 is designated at 18.

Figure 4:
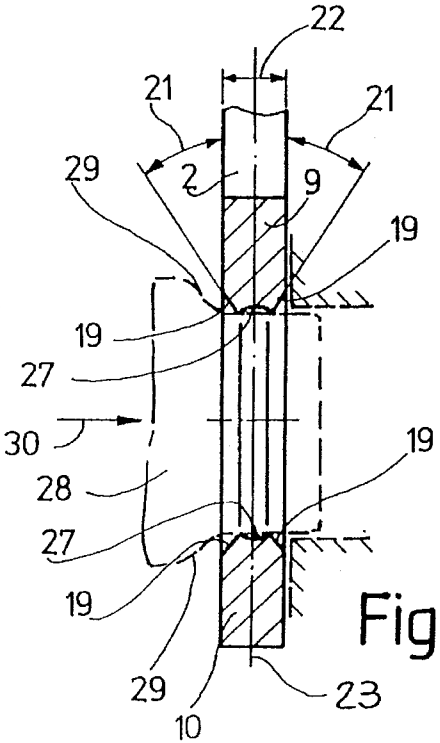
FIG. 4 is an enlarged sectional view taken along line IV—IV of FIG. 3.
Figure 3:
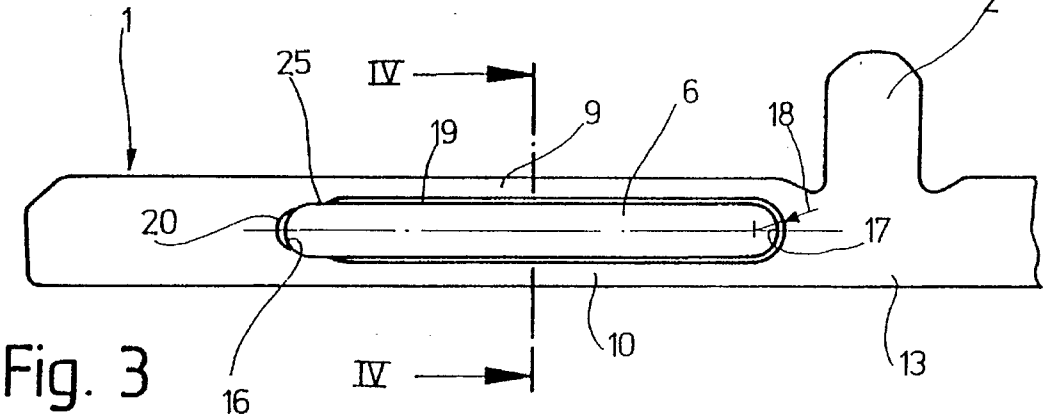
FIG. 3 is an enlarged, side elevational view of a needle shank portion provided with a window (without filler material), incorporating the invention.
Figure 5:
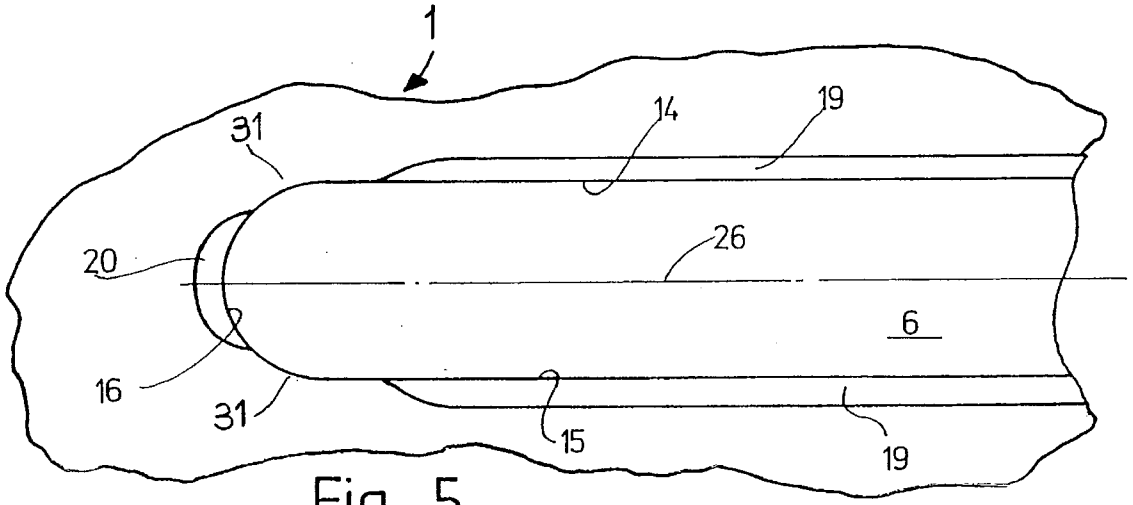
FIG. 5 is a fragmentary view of a needle shank and a window provided therein, showing chamfered peripheral parts according to the invention.

Along the edge of each window formed by an elongated aperture 6, the shank 1 is in sections chamfered inwardly towards the window as best seen in FIGS. 3, 4 and 5. The narrow, strip-like chamfered zones are designated at 19 and 20. These zones are situated on both opposite faces of the shank 1 and have throughout substantially the same chamfer angle 21 which is approximately 35° in the illustrated example. The angle may be chosen as a function of the shank thickness 22 and the type of the filler 8 as well as the operational conditions and properties of the knitting tool. Such angle is preferably between the values of 10° and 80°. The chamfer angles 21 may be of different values on opposite faces of the shank 1. The chamfers 19 and 20 render the window-framing shank edge cross-sectionally wedge-shaped. As it appears from FIG. 4, the imaginary crest line of such wedge lies in the longitudinal central plane 23 of the shank 1. In the actual construction shown in FIG. 4, the crest of the wedge defined by the chamfers 19, 20 is formed by a groove-like depression 27 extending symmetrically to the central plane 23. Further embodiments are feasible in which such a crest or crest line is offset relative to the longitudinal central plane 23 towards the one or the other side. Also, the chamfered zones 19, 20 may be of different widths.

As illustrated in FIGS. 3, 4 and 5, the chamfer 19 extends on each side of the shank 1 essentially along the length of the two straight window-framing edge portions 14, 15, while the chamfer 20 extends along the semicircular window-framing edge portions 16 and 17. The chamfer 19 terminates at each shank side at 25 at a short distance before the semicircular window-framing edge portion 16 to thus leave a chamfer-free zone 31 which is the transitional region between the linear parts 14, 15 and the curved part 16. The chamfered zone 20 extends on both shank sides along one part of the semicircular window-framing edge portion 16 and is arranged symmetrically to the longitudinal window axis 26. By virtue of the non-chamfered shank zone 31 there is achieved a favorable stress distribution in the shank 1 during operation. Further embodiments are feasible in which such chamferless zones are provided at other locations along the shank edge that frames the elongated window 6. For example, in that region of the narrow end which is oriented towards the butt 2, a chamfer 20 may be provided solely along one part of the length of the semicircular window-framing edge portion 17.

Turning to FIG. 7, each elongated aperture 6 is filled, for example, by spraying, with an oscillation damping filler 8 of synthetic material which is flush with the two opposite shank faces. The chamfers 19, 20 and the depression 27 project into the filler 8 and thus provide for a form-fitting anchor which firmly holds the filler 8 in place at the edge zones. The depression 27 constitutes an additional, second anchoring means. It is further feasible to pre-form the filler and press it into the respective elongated window 6 and anchor it in a form-fitting manner along the window-framing shank edge.

Reverting to FIG. 4, the chamfers 19 and 20 are provided by a stamping tool 28, whose length corresponds to the respective window 6 and which has chamfered portions 29 to provide the chamfers 19 and 20 in the shank 1. During the embossing process performed in the direction designated with the arrow 30, the shank material is, along the outline of the window 6, displaced inwardly and simultaneously the hollow wedge (depression) 27 is formed. The chamfered zones 19, 20 enclosing practically the entire outline of the window 6 provide for a superior anchoring of the plastic filler 8 whereby a local breakout is prevented. The cross-sectional area of the two webs 9 and 10 remains unchanged during the embossing process and thus will not be prone to breakage during service. The latch needle thus has a very low friction in the needle channel of the associated needle bed.

Figure 8:
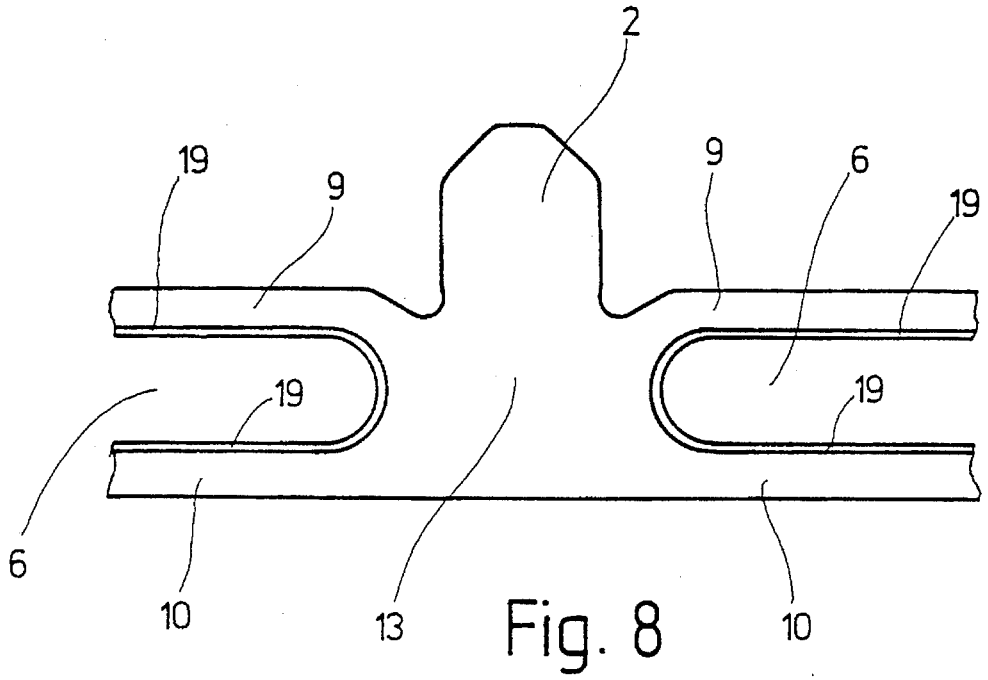
FIG. 8 is a fragmentary side elevational view of a knitting needle according to a further embodiment of the invention.
Figure 9:
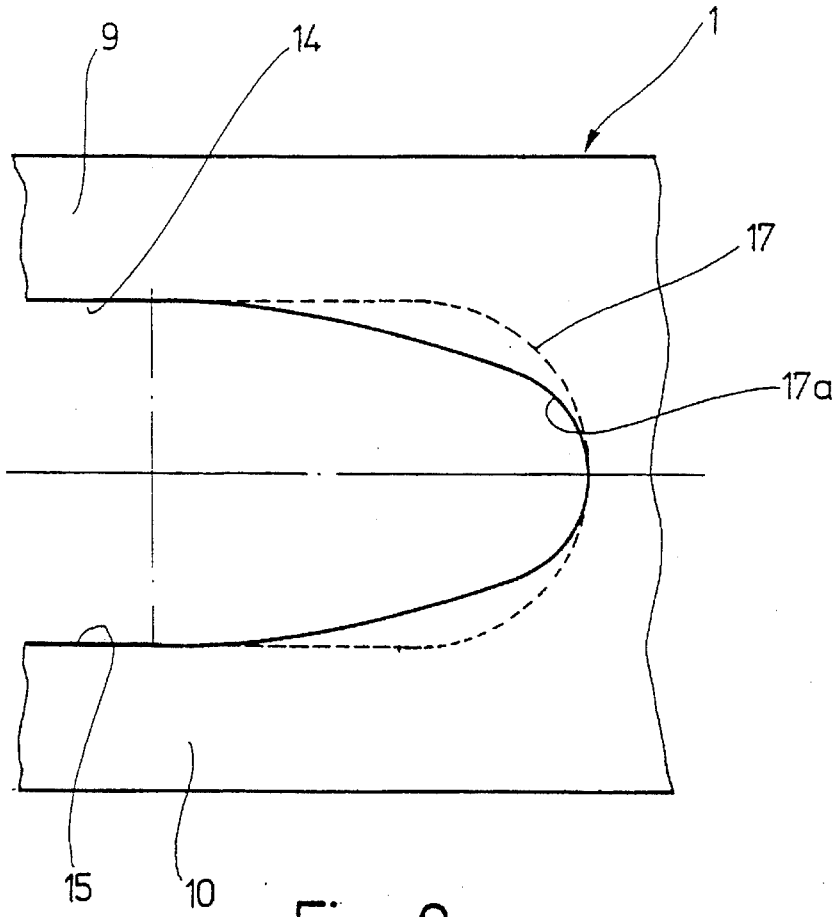
FIG. 9 is an enlarged fragmentary side elevational view of FIG. 8, showing additional details of the peripheral configuration of the window provided in the shank.

In the variant illustrated in FIGS. 8 and 9, the chamfered zone 19 extends in each instance along the entire closed outline of the elongated window 6. Departing from the embodiment illustrated in FIG. 1–7, the curvilinear edge portion interconnecting the straight edge portions 14 and 15 is elliptical rather than circular. To illustrate how the elliptical window-framing edge portion 17*a* takes the place of the circular edge portion 17, the latter is shown in phantom lines in FIG. 9. The elliptical edge portion 17*a* has a smooth transition to the linear edge portions 14 and 15. By virtue of this construction, upon stressing the latch needle, a better stress distribution in the zones of the narrow ends of the elongated aperture (window) 6 is obtained. It is a contributing factor that the webs 9 and 10 have at their ends a smoother cross-sectional change as the straight edges change into an elliptical line than when a semicircular connecting line is used.

Elliptically curved window-framing edge portions 17*a* may be provided at each elongated window 6 on both narrow ends thereof. It is, however, frequently sufficient only to provide such an elliptical transition at one narrow end while at the other narrow end a circular connecting edge 17 is used. The elliptical edge portion 17*a* may be oriented towards a butt 2 or the needle head 3.

As a departure from the illustrated embodiments other knitting needles or, in general, knitting tool constructions are possible which, for example, have only a single butt 2 and/or only a single elongated window 6 and the outline of the window may be other than elongated: it may be, for example, of circular, slot-like or V-shaped form.

It will be understood that the above description of the present invention is susceptible to various modifications, changes and adaptations, and the same are intended to be comprehended within the meaning and range of equivalents of the appended claims.

What is claimed is:

1. A stamped knitting tool comprising (a) a shank;

(b) a window provided in said shank; said window being bounded by a surrounding window-framing edge of said shank;

(c) a chamfer provided along at least a length portion of said window-framing edge; said chamfer bordering said window; and (d) a heterogenous material filling said window and being fixedly connected with said shank; said chamfer projecting into said material.

2. The stamped knitting tool as defined in claim 1, wherein said chamfer has a crest constituted by a depression.

3. The stamped knitting tool as defined in claim 1, wherein said chamfer is embossed in said shank.

4. The stamped knitting tool as defined in claim 1, wherein said shank is a flat component having opposite large surfaces; said chamfer being provided on said window-framing edge at both said surfaces.

5. The stamped knitting tool as defined in claim 1, wherein said chamfer is provided along a plurality of length portions of said window-framing edge; further wherein said chamfer has a chamfer angle being substantially identical for each said length portion.

6. The stamped knitting tool as defined in claim 5, wherein said chamfer angle is between 10° and 80°.

7. The stamped knitting tool as defined in claim 6, wherein said chamfer angle is approximately 35°.

8. The stamped knitting tool as defined in claim 1, wherein said shank has a length dimension and opposite first and second longitudinal bordering edges; further wherein said window has the shape of an elongated aperture having a length dimension; said window-framing edge having opposite first and second long sides extending parallel to said length dimension of said shank and opposite short sides interconnecting the long sides; said window being bordered along the length dimension thereof by a first shank web defined between and including said first longitudinal bordering edge and said first long side and by a second shank web defined between and including said second longitudinal bordering edge and said second long side; said chamfer being provided on said first and second shank webs.

9. The stamped knitting tool as defined in claim 1, wherein said window-framing edge includes curved length portions and said chamfer is provided at least partially along said curved length portions.

10. The stamped knitting tool as defined in claim 9, wherein at least one of said curved length portions has a substantially elliptical shape.

* * * * *